US005433263A

United States Patent [19]

Ohnishi et al.

[11] Patent Number: 5,433,263

[45] Date of Patent: Jul. 18, 1995

[54] CASTING EJECTOR

[75] Inventors: Nobuaki Ohnishi, Ibaragi; Yasuo Iizuka, Saitama, both of Japan

[73] Assignee: Hitachi Metals, Ltd., Tokyo, Japan

[21] Appl. No.: 140,461

[22] Filed: Oct. 25, 1993

[30] Foreign Application Priority Data

Oct. 28, 1992 [JP] Japan ..... 4-314082

[51] Int. Cl.[6] ..... B22D 29/00

[52] U.S. Cl. ..... 164/347; 249/67

[58] Field of Search ..... 164/347; 249/67, 68; 425/444

[56] References Cited

U.S. PATENT DOCUMENTS 4,009,978 3/1977 Hanning ..... 249/68 X 4,889,311 12/1989 Anglin ..... 249/68

FOREIGN PATENT DOCUMENTS 57-79063 5/1982 Japan .

62-93056 4/1987 Japan ..... 164/347

*Primary Examiner*—J. Reed Batten, Jr.

*Attorney, Agent, or Firm*—Finnegan, Henderson, Farabow, Garrett & Dunner

[57] ABSTRACT

The casting ejector includes a forcibly cooled ejector plate and a plurality of depending, solid ejector pins of high thermal conductivity cooperate with a casting mold to increase the strength of specifying portions of the casting. Copper, nickel, and alloys of each having a thermal conductivity of 40 W/mK or more are used, and the pins are disposed to contact high-stress locations of the casting.

5 Claims, 2 Drawing Sheets

CASTING EJECTOR

BACKGROUND OF THE INVENTION

1. Field of the Invention

This invention relates to casting of metals, especially casting of light metals and their alloys, and more particularly relates to increasing strength of specific portions of a casting.

2. Description of the Prior Art

In casting of metals, for example in casting of an aluminum car wheel, ejector pins are used to separate the casting from the mold. The pins conventionally are made of tool steel or hot mold steel. And in conventional casting methods, the whole mold cavity is filled up with the molten metal alone, and also no specific design is given to the surface configuration of the casting.

Since the tool steel or hot mold steel used for the conventional ejector pins has a relatively low thermal conductivity of 30.5 W/m.K (at 20° C. ), those portions of the casting which contact with the pins cool down relatively slowly, so that they are not so mechanically strong as they could be. Also in the conventional casting methods, since no specific contrivance is given in filling the cavity with the molten metal and no specific design is given to the surface configuration of the casting, i.e., to the shape of the cavity, it is not possible to obtain a casting having specific portions increased in strength.

However, in case of an aluminum car wheel, for example, it is often the case that as long as certain portions of the wheel are satisfactorily strong, the strength of the rest of the wheel is not so important. It is also the case that as long as the front and decorative side of the wheel being visible when fitted to a car is smooth, the appearance of the rear of the wheel is not so important. The conventional ejector pins and casting methods mentioned above provide no means for increasing strength of specific portions of the casting, such as the portions not visible in use, and hence provide no means for decreasing the weight of the casting.

SUMMARY OF THE INVENTION

It is, therefore, an object of the present invention to provide an ejector pin for casting mold and casting method, which can increase mechanical strength of specific portion of a casting so that the weight of the casting can be reduced.

According to the present invention, the above specified object has been achieved by three parts. The first part of the invention is an ejector pin installed in a mold to separate a casting from the mold and having a portion projected outside of the mold; the extrusion pin being made of material having thermal conductivity of 40 W/m.K or more and the projected portion being forcedly cooled. The second part of the invention is a casting method of introducing molten metal into a cavity formed by a mold; wherein a fiber-reinforced compound member is positioned at a portion of the cavity in advance of the introducing of the molten metal into the cavity. And the third part of the invention is a casting method of introducing molten metal into a cavity formed by a mold to form a casting; wherein the cavity is so shaped that a cooling fin is formed on a portion of a surface of the casting.

With the first part of the invention, since the ejector pin is of high thermal conductivity and is also cooled, the portion of the casting which contacts with the pin cools quickly, so that the strength of the portion increases. With the second part of the invention, since a fiber-reinforced compound member is internally positioned to form a integral casting, the strength of the casting increases in that portion having the member. With the third part of the invention, since a cooling fin is formed on the surface of the casting, the molten metal flows in order so that casting defects can be minimized. And blowholes which might appear at the surface of the casting can be eliminated or, at the least, they are limited to occur inside of the casting. Moreover, the strength of the portion forming a fin increases as it cools more quickly.

BRIEF DESCRIPTION OF THE DRAWINGS

Other objects and advantages of the present invention will become apparent from the following description to be made with reference to the accompanying drawings, in which.

DETAILED DESCRIPTION OF THE PREFERRED EMBODIMENT

Figure 1:
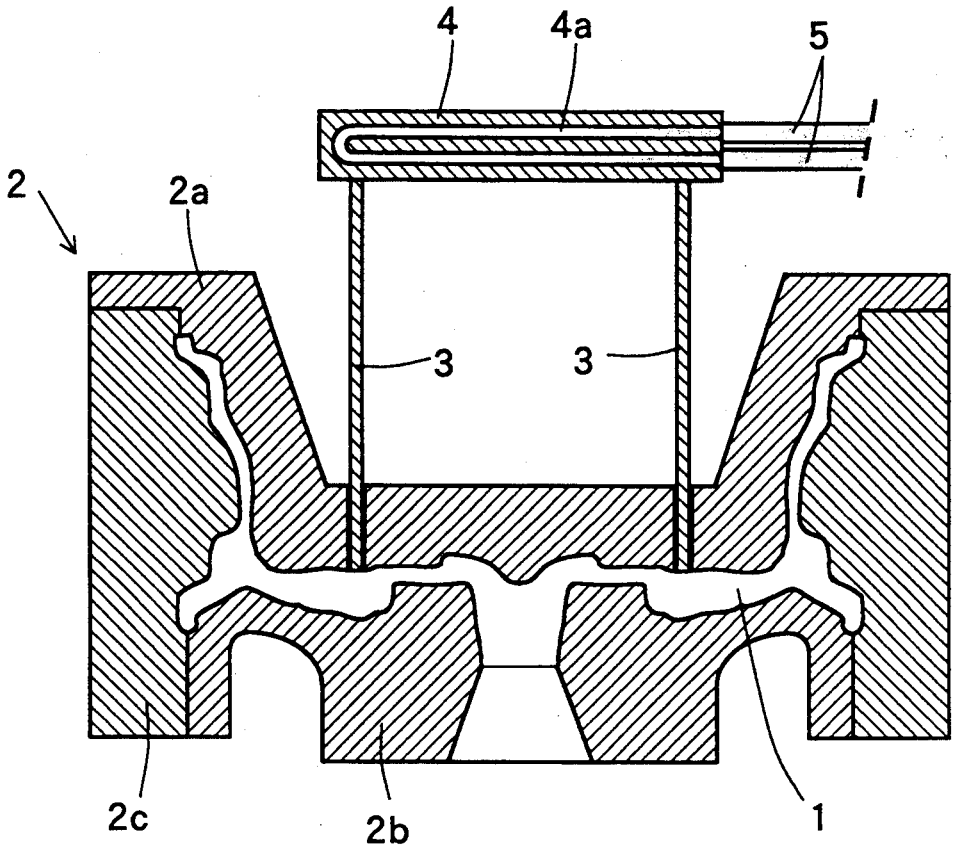
FIG. 1 is a sectional front elevation showing a first embodiment of the present invention.

The invention will now be described in more detail with reference to the accompanying drawings. FIG. 1 shows a first embodiment of the present invention, wherein a mold cavity 1 in the shape of an aluminum car wheel is formed by a casting mold 2. The mold 2 is made up of an upper mold 2*a*, a lower mold 2*b*, and a side mold 2*c*. Several ejector pins 3 are installed in the upper mold 2*a* for separating the cast wheel from the mold 2. Each ejector pin 3 is made of copper alloy and has a lower end penetrating through the upper mold 2*a* and facing the mold cavity 1, and an upper end projecting outside of the upper mold 2*a* and fixedly secured to an ejector plate 4. The ejector plate 4 is formed internally with a cooling water channel 4*a*, which is connected to a cooling water piping 5.

With the construction described above, since the copper alloy used for the ejector pins 3 has a thermal conductivity of 398 W/m.K, remarkably higher than that of tool steel or hot mold steel, and since the upper ends of the ejector pins are secured to the ejector plate 4 which is cooled by a cooling water piping 5, the portions of the casting which contact with the ejector pins cool down quickly, so that the mechanical strength of those portions of the wheel increase. It is, therefore, desirable that the lower ends of the pins 3 be so positioned that they face those portions of the wheel where the stresses in use are high. Although copper alloy is used for the ejector pins 3 in this embodiment, it is desirable to use material having thermal conductivity of not less than 40 W/m.K to obtain notable improvements compared to the conventional technology. For this purpose, nickel (thermal conductivity of 90.5 W/m.K) and its alloy can be used besides copper and its alloy.

Figure 2:
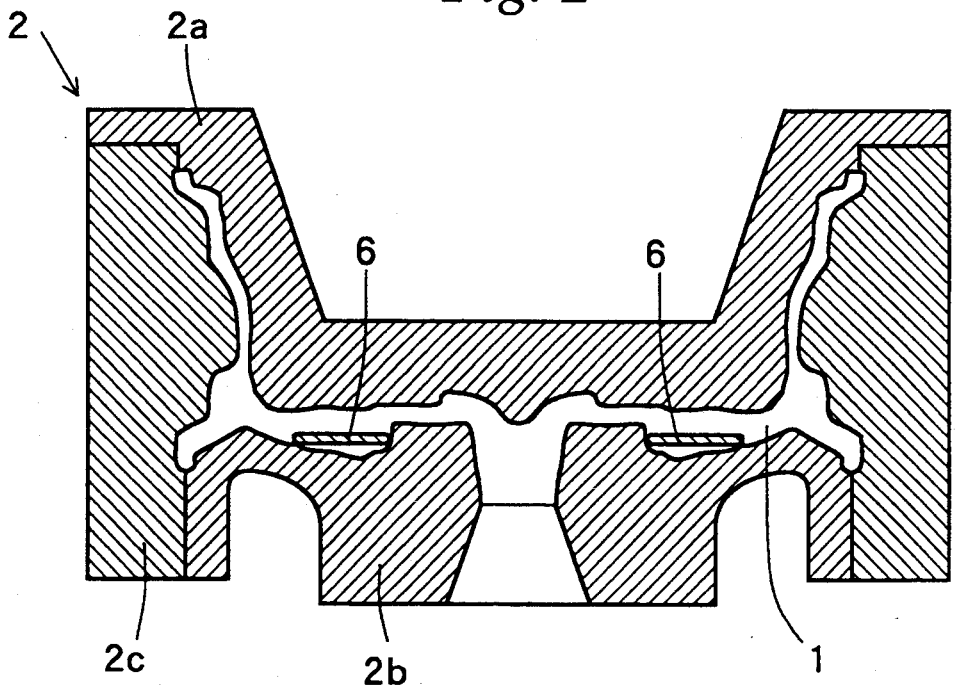
FIG. 2 is a sectional front elevation showing a second embodiment of the present invention.

FIG. 2 shows a second embodiment of the present invention, wherein carbon fibers 6 are positioned in advance at the portions of the cavity 1 which corresponds to those portions of the wheel where the stresses in use are high, and then casting is done by introducing the molten metal into the cavity 1. Therefore with this embodiment, the strength increases at the portions of the wheel where the carbon fibers 6 are positioned. Although carbon fibers 6 are used in this embodiment, silica fibers, alumina fibers, or boron nitride fibers can be used instead of the carbon fibers 6.

Figure 3:
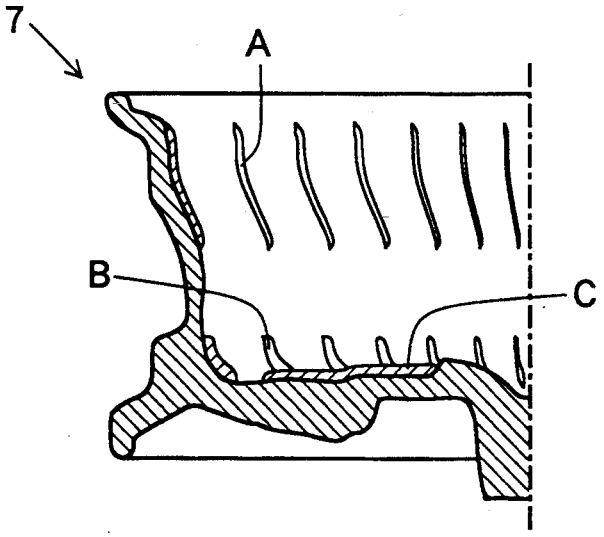
FIG. 3 is a sectional front elevation showing a left-half of a third embodiment of the present invention.

FIG. 3 shows a third embodiment of the present invention, wherein the cavity is so shaped that cooling fins A, B, and C are formed respectively on the rear side of the thin part, on the rear side of the thick part and on the rear side of the flange part of the aluminum car wheel 7. The cooling fins A on the rear side of the thin part straighten the flow of the molten metal through the thin part. The cooling fins B on the rear side of the thick part make the final solidification of the molten metal to end at the inside of the thick part. And the cooling fins C on the rear side of the flange part increase the cooling rate of the flange part so as to increase its strength. The appearance of the wheel 7, on the other hand, is not deteriorated since all the fins A, B, and C are positioned on the rear side of the wheel 7.

Thus, the present invention makes it possible to increase the strength of a specific portion of a casting, by increasing the cooling rate of the portion, by providing fiber-reinforced compound member at the portion to form a integral casting, and by making the flow of the molten metal in order and controlling the casting fault.

Although the embodiments of the present invention have been described above, various modifications are possible without departing from the spirit of the invention which is defined solely in the appended claims.

What is claimed is:

1. A casting ejector for separating a casting from mold, comprising an ejector plate and at least one solid ejector pin having an inner end disposed to face the casting and an outer end connected to said ejector plate to provide conductive heat transfer from said outer end to said ejector plate, said ejector pin being made of material having thermal conductivity of 40 W/m.K or more and said ejector plate including means for being forcedly cooled.

2. The casting ejector as in claim 1, wherein said cooling means includes fluid flow passages.

3. The casting ejector as in claim 4, wherein said fluid flow passages are sized for water coolant flow.

4. The casting ejector as in claim 1, wherein said ejector pin is formed from a material selected from the group consisting of copper, copper alloys, nickel, and nickel alloys, and is sized for ejecting a metal casting.

5. The casting ejector as in claim 1, wherein said ejector pin inner end is disposed to contact the casting at a casting location where increased strength is desired.

* * * * *

UNITED STATES PATENT AND TRADEMARK OFFICE

CERTIFICATE OF CORRECTION

PATENT NO. : 5,433,263

DATED : July 18, 1995

INVENTOR(S) : OHNISHI et al.

It is certified that error appears in the above-indentified patent and that said Letters Patent is hereby corrected as shown below:

Claim 1, col. 4, line 9, change "mold" to --a mold--.

Claim 1, col. 4, line 14, change "W/m.K to --W/m·K--.

Signed and Sealed this

Fifth Day of September, 1995

*Attest:*

*Attesting Officer*

Bruce Lehman

BRUCE LEHMAN

*Commissioner of Patents and Trademarks*